US006299279B1

(12) United States Patent
Asada

(10) Patent No.: US 6,299,279 B1
(45) Date of Patent: Oct. 9, 2001

(54) INK JET PRINTER AND WASTE INK ABSORBING BODY THEREFOR

(75) Inventor: Hidekazu Asada, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/139,714

(22) Filed: Aug. 25, 1998

(30) Foreign Application Priority Data

Aug. 25, 1997 (JP) ..... 9-227695

(51) Int. Cl.[7] ..... B41J 2/165
(52) U.S. Cl. ..... 347/36; 347/31; 347/35
(58) Field of Search ..... 347/36, 86, 31, 347/22, 29, 30, 35; 401/198, 199, 238, 292; 428/66.6

(56) References Cited

U.S. PATENT DOCUMENTS 5,113,206 * 5/1992 Fukasawa ..... 347/36
5,821,955 * 10/1998 Waschhauser ..... 347/36

FOREIGN PATENT DOCUMENTS 3-227658 10/1991 (JP) .
404044861A * 2/1992 (JP) ..... 347/36

* cited by examiner

*Primary Examiner*—N. Le
*Assistant Examiner*—Shih-wen Hsieh
(74) *Attorney, Agent, or Firm*—Foley & Lardner

(57) ABSTRACT

A waste ink absorbing body for an ink jet printer of the present invention includes a stack of unique blotting papers. Apertures are formed in each blotting paper such that they partly overlap each other when the blotting papers are stacked. Waste ink is allowed to efficiently infiltrate into the blotting papers to all the corners due to capillary caused by the overlapping apertures.

10 Claims, 1 Drawing Sheet

INK JET PRINTER AND WASTE INK ABSORBING BODY THEREFOR

BACKGROUND OF THE INVENTION

The present invention relates to an ink jet printer and, more particularly, to a waste ink absorbing body for an ink jet printer.

Generally, an ink jet printer extensively used today includes a waste ink absorbing body for absorbing waste ink. Japanese Patent Laid-Open Publication No. 3-227658, for example, teaches a waste ink absorbing body received in a waste ink tank and implemented by a simple stack of blotting papers having a great ink absorbing and holding ability. However, the absorbing body taught in this document has a drawback that waste ink infiltrates conically into the blotting papers and sets in a conical configuration. As a result, substantial part of the absorbing body is simply wasted. Further, because the absorbing body locally absorbs the ink at its center portion, it needs a disproportionate capacity for an expected amount of ink absorption and therefore occupies substantial part of a limited space available in the body of an ink jet printer.

SUMMARY OF THE INVENTION

It is therefore an object of the present invention to provide a waste ink absorbing body capable of absorbing waste ink efficiently and thereby reducing cost and space to be allocated thereto, and an ink jet printer using the same.

In accordance with the present invention, an ink absorbing body has a stack of a plurality of blotting papers. The blotting papers each is formed with a plurality of apertures.

Also, in accordance with the present invention, an ink jet printer includes an ink absorbing body in which a plurality of blotting papers each being formed with a plurality of apertures are stacked.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 1:
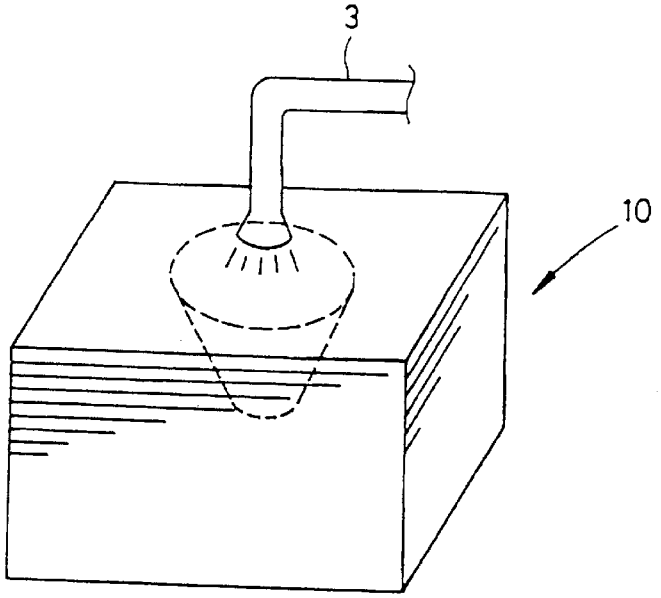
FIG. 1 PRIOR ART
FIG. 1 is a perspective view showing a conventional waste ink absorbing body for an ink jet printer.

To better understand the present invention, brief reference will be made to a conventional waste ink absorbing body included in an ink jet printer, shown in FIG. 1. As shown, the absorbing body, generally 10, is implemented as a stack of blotting papers having a great ink absorbing and holding ability. A pipe 3 is positioned above substantially the center of the absorbing body 10. When waste ink is dropped from the end of the pipe 3, it sequentially infiltrates into the blotting papers of the absorbing body 10. However, the problem is that the ink infiltrates conically into the absorbing body 10 and sets in a conical configuration, as indicated by a dotted line in FIG. 1. As a result, the ink is absorbed only by the center portion of the absorbing body 10. This prevents the blotting papers constituting the absorbing body 10 from being effectively or efficiently used. Moreover, the absorbing body 10 is bulky and occupies substantial part of a limited space available in the printer.

Figure 2:
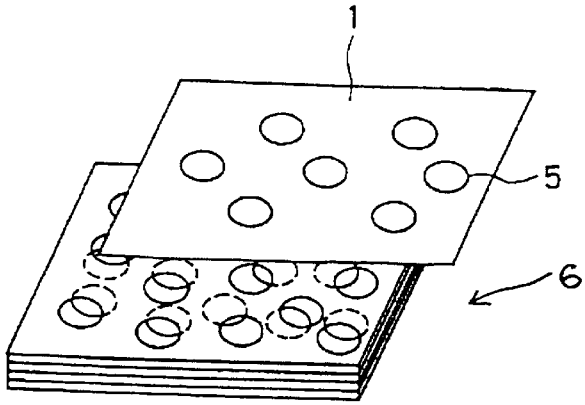
FIG. 2 is a perspective view showing a waste ink absorbing body embodying the present invention.

Referring to FIG. 2, a waste ink absorbing body 6 embodying the present invention is shown and generally designated by the reference numeral 6. As shown, the absorbing body 6 is implemented as a stack of blotting papers 1. The blotting papers 1 each is formed with a suitable number (plurality) of apertures 5. The apertures 5 are positioned such that they are sequentially shifted little by little while overlapping each other over an area of 10% to 50% when the blotting papers 1 are stacked. The edges of the overlapping apertures 5 allow waste ink to smoothly infiltrate into the blotting papers 1 to all the corners due to capillarity. The apertures 5 should preferably have a diameter of 3 mm to 10 mm.

Figure 3:
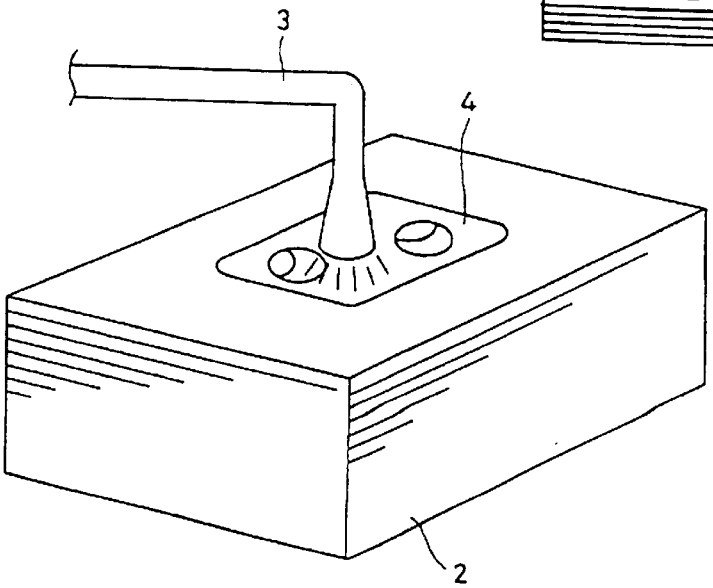
FIG. 3 is a perspective view showing a cartridge accommodating the absorbing body shown in FIG. 2.

FIG. 3 shows a cartridge 2 accommodating the waste ink absorbing body 6. As shown, the cartridge 2 is formed with an ink inlet 4 in its top while a pipe 3 is positioned above the ink inlet 4. When waste ink discharged from the body of an ink jet printer, not shown, is dropped from the pipe 3 to the ink inlet 4, the ink infiltrates into the stack of blotting papers 1 received in the cartridge 2. The blotting papers 1 each may be sized 80 mm×80 mm to 100 mm×100 mm by way of example.

In summary, in accordance with the present invention, unique blotting papers formed with a plurality of apertures are stacked to constitute a waste ink absorbing body. The apertures allow waste ink to infiltrate into the blotting papers to all the corners due to capillarity. Therefore, the absorbing body promotes the effective use of the blotting papers and thereby reduces running cost. Further, the capacity of the blotting papers and therefore the size of the entire absorbing body can be reduced for an expected amount of ink absorption because of the smooth infiltration of the waste ink to all the corners. Consequently, the absorbing body occupies a minimum of space in the body of an ink jet printer.

Various modifications will become possible for those skilled in the art after receiving the teachings of the present disclosure without departing from the scope thereof.

What is claimed is:

1. An ink absorbing body comprising a plurality of stacked blotting sheets, each with a plurality of apertures, wherein said blotting sheets are stacked such that said apertures of said blotting sheets partly overlap each other.

2. An ink absorbing body as claimed in claim 1, wherein ink is caused to infiltrate into said blotting sheet due to capillarity caused by said apertures.

3. An ink absorbing body as claimed in claim 2, wherein said apertures are formed over an entire area of each of said blotting sheets.

4. An ink absorbing body as claimed in claim 2, wherein said blotting sheets are used to absorb waste ink.

5. An ink absorbing body as claimed in claim 2, wherein said apertures are formed over an entire area of each of said blotting sheets.

6. An ink absorbing body as claimed in claim 2, wherein said blotting sheets are used to absorb waste ink.

7. An ink absorbing body according to claim 2, wherein the blotting sheets are made of paper.

8. An ink jet printer using an ink absorbing body comprising a plurality of stacked blotting sheets, each with a plurality of apertures, wherein the apertures of the blotting sheets partly overlap each other.

9. An ink jet printer according to claim 8, wherein the blotting sheets are made of paper.

10. An ink jet printer according to claim 8, wherein the blotting sheets are made of paper.

* * * * *